US006056253A

United States Patent [19]

Tripp

[11] Patent Number: 6,056,253

[45] Date of Patent: May 2, 2000

[54] PAINTBRUSH HOLDER HAVING LENGTH ADJUSTMENT

[76] Inventor: Dave L. Tripp, 349 Rice Ranch Rd., Orcutt, Calif. 93455

[21] Appl. No.: 09/135,467

[22] Filed: Aug. 17, 1998

[51] Int. Cl.[7] ..... A47B 96/06

[52] U.S. Cl. ..... 248/213.2; 248/110

[58] Field of Search ..... 248/682, 689, 248/213.2, 110, 113, 231.81

[56] References Cited

U.S. PATENT DOCUMENTS

| | | | |
|---|---|---|---|
| 499,842 | 6/1893 | Long | 248/113 X |
| 568,121 | 9/1896 | Varian | 248/113 |
| 1,643,661 | 9/1927 | Kendall | 248/113 |
| 2,402,374 | 6/1946 | Corn et al. | 248/110 |
| 2,454,474 | 11/1948 | Nance | 248/113 |
| 2,555,053 | 5/1951 | Myrick et al. | 248/113 |
| 2,675,979 | 4/1954 | Vetterli et al. | 248/113 |
| 2,807,431 | 9/1957 | McHale | 248/113 |
| 3,536,285 | 10/1970 | Vaughn | 248/110 X |
| 4,121,798 | 10/1978 | Schumacher et al. | 248/113 |
| 5,823,483 | 10/1998 | Gaskill | 248/213.2 X |
| 5,853,157 | 12/1998 | O'Donnell | 248/213.2 |

*Primary Examiner*—Ramon O. Ramirez
*Attorney, Agent, or Firm*—Larry Baker

[57] ABSTRACT

An accessory for use with a paintbrush is disclosed, which releasably attaches to the handle of the paintbrush and provides a means of resting the brush on an external support while preventing the "wet" end of the brush from contacting nearby surfaces. The paintbrush accessory provides several alternative ways of supporting a paintbrush on an external support, and may be easily modified by the user. The accessory is preferably integrally molded of a resilient plastic, such that it is inexpensive to the consumer and may be disposed of or recycled after use.

6 Claims, 4 Drawing Sheets

PAINTBRUSH HOLDER HAVING LENGTH ADJUSTMENT

BACKGROUND OF THE INVENTION

1. Field of the Invention

The present invention relates to accessories for use with paintbrushes, and more specifically to devices which attach to a paintbrush to facilitate resting the brush temporarily when in use, while holding the wet end of the brush away from nearby surfaces.

2. Description of the Prior Art

The practice of painting, to protect the surface of objects, to enhance their appearance, and for purely artistic purposes, is ancient. The basic method of using a brush, having a handle at one end and bristles at the other, dipped into a container of paint, has changed little.

Perhaps nearly as ancient is the problem of what to do with a paintbrush, loaded with paint, when it is necessary to temporarily sit down the brush. A painter may need to do preparation on the work site; move a ladder or other equipment; or use a different size brush or a brush with a different color of paint. Simply resting the brush on a convenient surface risks both getting paint on the surface and contaminating the brush with dirt and debris.

Many solutions to the problem have been tried. Most involve some sort of paintbrush holder mounted to the paint can or bucket, or some other fixed object such as a ladder; the paintbrush is returned to the holder when not in use. The drawback to such an approach is that it may not be convenient for the painter to return the brush to the holder, since the holder may be some distance away. The painter, for example, may be at the top of a ladder, with the need to momentarily rest the brush, while the paintbrush holder is attached to the paint bucket at the bottom of the ladder.

Professional painters will often invest in good quality paintbrushes, which are typically more effective and pleasant to use, produce better results, and, when properly maintained, may be used indefinitely. Having invested in an expensive paintbrush, professional painters have been know to pound a nail into the handle of the brush, such that the brush may be hung temporarily by the nail when required.

The broad range of prior art paintbrush holders thus do not meet the need for a very simple device which may be securely attached to a brush, and which remains with the brush, always ready should it be necessary to temporarily rest the brush, but which does not interfere with the normal use of the brush. Many existing paint brush holders are also relatively complex, consisting of an assembly of parts, and therefore of sufficient cost that a consumer might be reluctant to purchase the holder in the first place, and would feel compelled to clean and reuse the brush holder, rather than disposing of it after use. A consumer would also be reluctant to modify an expensive brush holder to meet a particular need, since the consumer would be risking the destruction of a relatively costly device.

SUMMARY OF THE INVENTION

In view of the shortcomings of current paintbrush accessories, it is the object of the present invention to provide a paintbrush accessory which may be securely attached to a paintbrush, and therefore ready for use whenever it is needed, and which provides a convenient means of hanging the paintbrush on an available support, while preventing the wet end of the brush from contacting nearby surfaces;

It is a further object of the present invention to provide a paintbrush accessory which is integrally formed of a resilient plastic material, and is therefore inexpensive to the consumer, and which may be disposed of after use;

It is a further object of the invention to provide a paintbrush accessory which is easily adapted to particular situations, and which may be easily modified by the consumer.

BRIEF DESCRIPTION OF THE DRAWINGS

The invention is further described in connection with the accompanying drawings, in which.

DESCRIPTION OF THE PREFERRED EMBODIMENT

Figure 1:
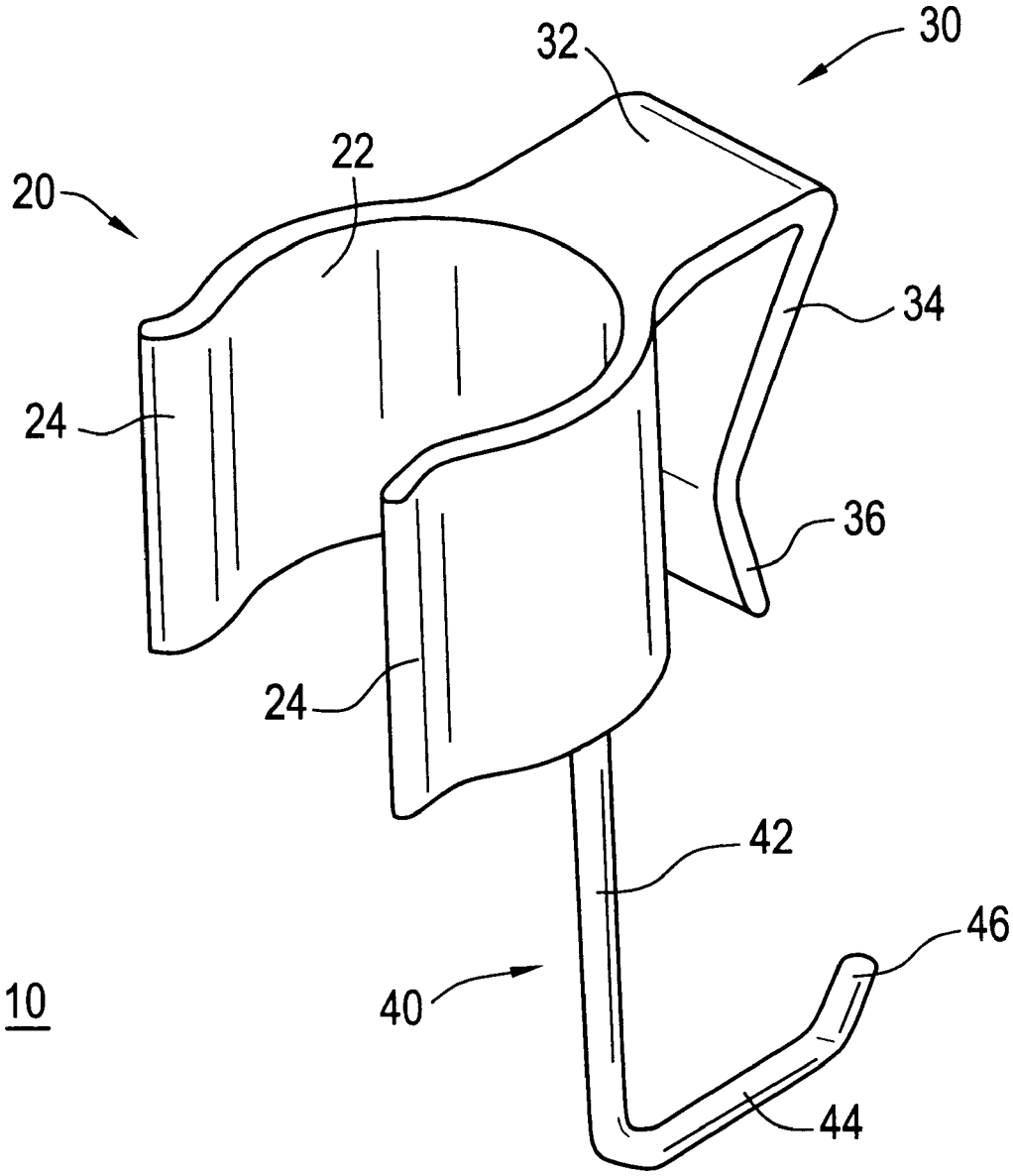
FIG. 1 is a perspective view of the preferred embodiment.
Figure 2:
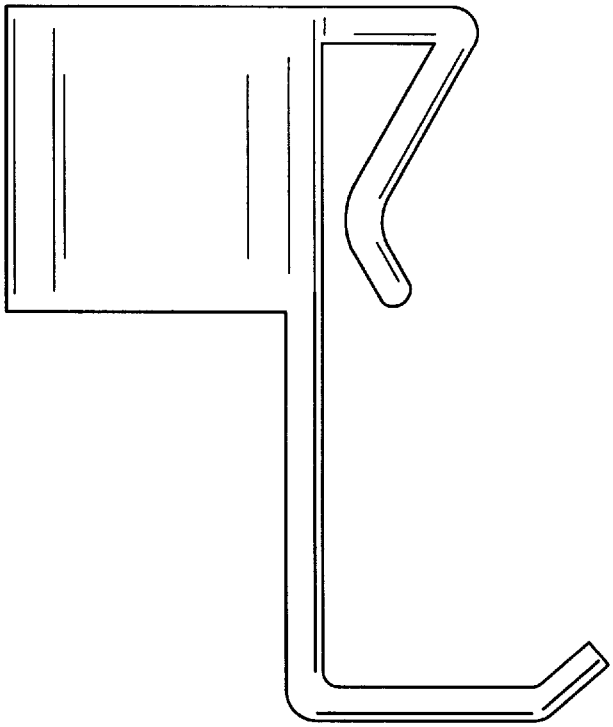
FIG. 2 is a side view of the preferred embodiment.
Figure 3:
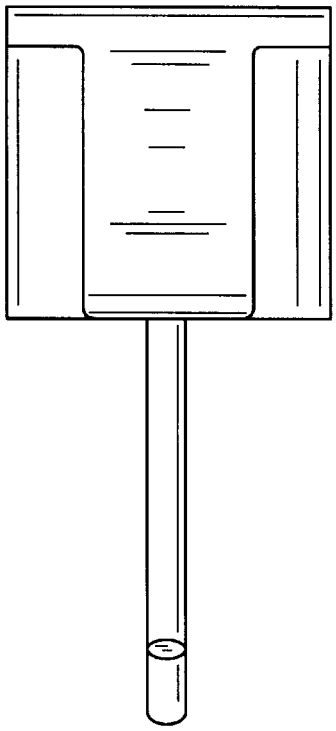
FIG. 3 is a back view of the preferred embodiment.
Figure 4:
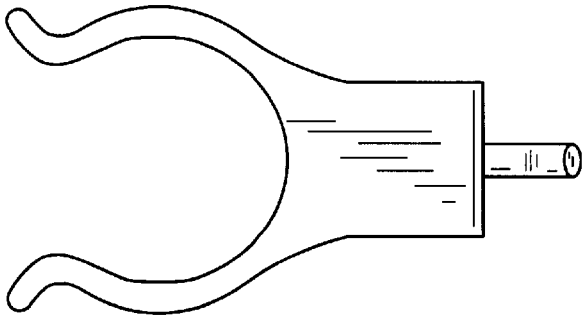
FIG. 4 is a top view of the preferred embodiment.

As illustrated in FIGS. 1 through 4, the paintbrush accessory 10 comprises a paintbrush engaging member 20, a clip member 30, and a spacing member 40. The paintbrush accessory is adaptable to be used in a variety of ways, as will be fully described below. The preferred embodiment of the paintbrush accessory is integrally formed of a resilient plastic material.

Figure 5:
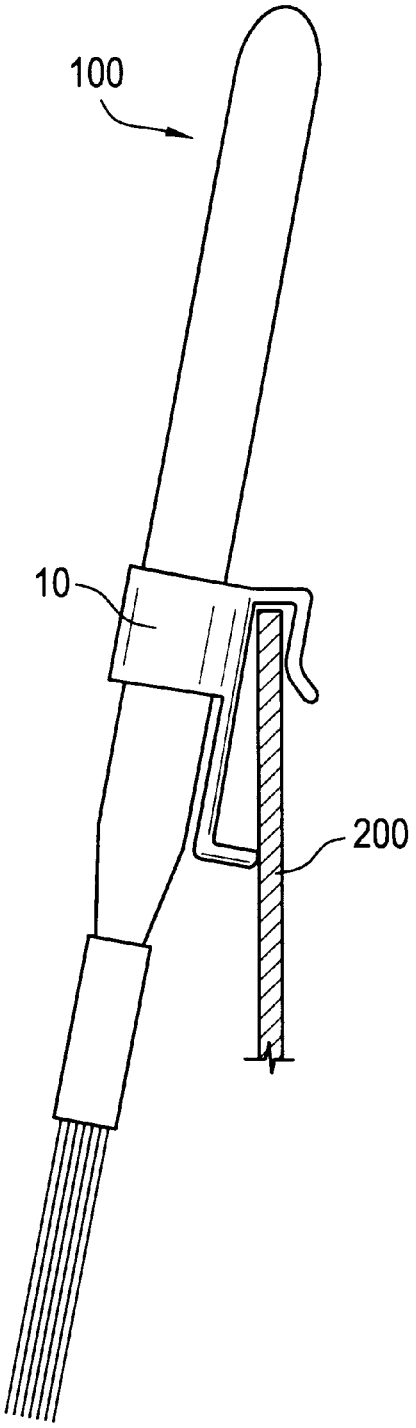
FIG. 5 illustrates use of the paintbrush accessory, with the spacing member holding the bristle or "wet" end of a paintbrush away from a resting surface.
Figure 6:
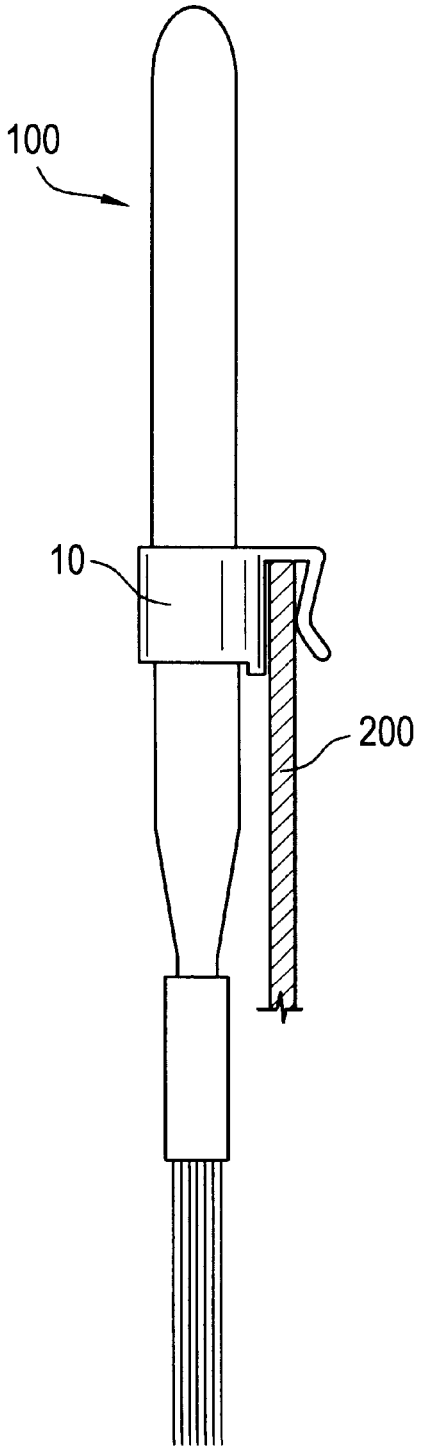
FIG. 6 illustrates how the painting accessory may be easily modified by clipping off the spacing member.

The function of the paintbrush engaging member 20 is to secure the paintbrush accessory to the handle of the paintbrush 100 (ref. FIGS. 5 and 6). In the preferred embodiment, the paintbrush engaging member comprises a partial cylinder portion 22 which, when mounted on the brush, engages more than half of the circumference of the brush handle. In its uninstalled state, the inner diameter of the partial cylinder is somewhat smaller than the diameter of the paintbrush handle, and, being formed of a resilient material, the partial cylinder once installed on the brush handle thus securely retains the paintbrush accessory to the brush. To assist in installing the paintbrush accessory on the paintbrush handle, flanges 24 on either side of the open force open the partial cylinder 22 when a paintbrush handle is pressed against the flanges.

Although a substantially cylindrical paintbrush engaging member is illustrated, the engaging member may be made to accommodate other common paintbrush handle designs, such as the common flattened oval cross section handle. Further, other means of attaching the paintbrush accessory to a paintbrush are possible, such as an adhesive strip or a device similar to a common plastic cable tie could completely encircle the handle.

The clip member 30 serves as the primary means of retaining the paintbrush accessory 10 and paintbrush 100 to an external support 200 (see FIGS. 5 and 6). The clip member 30 of the preferred embodiment comprises a spacing segment 32, a retaining segment 34, and a flange segment 36. The spacing segment 32 of the clip is connected to the cylindrical segment of the paintbrush engaging member 22, and serves to space the retaining segment of the clip away from the paintbrush engaging member, providing room between the paintbrush engaging member and the retaining segment 34 to accommodate a variety of external supports, such as a ladder brace, the rim of a paint bucket, or the painter's belt. The retaining segment 34 is biased back towards the paintbrush engaging member 20, such that the resilient flex of the clip member will securely retain the paintbrush accessory to external supports of a variety of thicknesses. Flange segment 36 serves to facilitate placement of the clip on an external support by allowing the retaining segment to be easily pulled back away from the paintbrush engaging member.

Figure 7:
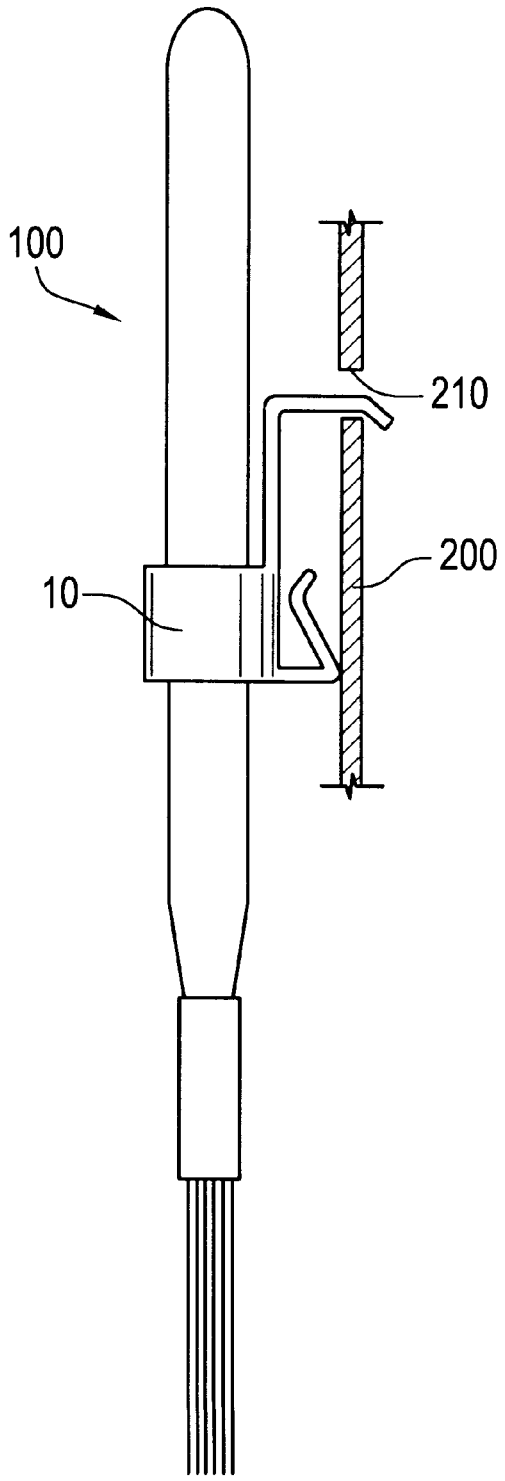
FIG. 7 illustrates how the spacing member may be utilized as hook for hanging a paintbrush.

The spacing member 40 serves to prevent the wet end of the paintbrush from contacting nearby surfaces and also serves as a secondary means of retaining the paintbrush accessory and paintbrush to a external support (see FIG. 7). The spacing member of the preferred embodiment comprises a vertical connecting segment 42, a spacing segment 44, and a hook segment 46. The vertical connecting segment 42 extends from the paintbrush engaging member 20 and serves to place the spacing segment 44 a sufficient distance from the clip member such that the spacing segment may effectively hold the paintbrush away from the external support (if the spacing member were too close to the clip, the leverage of the paintbrush over the small distance could serve to defeat the spacing function).

The spacing member 40 of the preferred embodiment is formed with a small diameter circular cross section. The small diameter allows the spacing segment 44 and hook segment 46 to be used as a secondary means of retaining the paintbrush accessory and paintbrush to an external support; the spacing segment 44 and hook segment 46 serve as a hook which may be hung through a hole 210 in the external support (see FIG. 7).

The small diameter of the spacing member 40 also allows the paintbrush accessory to be adapted to a variety of situations by trimming the spacing member with wire cutters or the like. For example, the distance the wet end of the paintbrush is spaced from the support may be adjusted by shortening the spacing member (see FIG. 5, or the spacing member may be removed altogether for applications where spacing is not desired (see FIG. 6).

The preferred material for the paintbrush accessory is an inexpensive resilient plastic, which may be formed with injection molding. Integral molding of the paintbrush accessory and use of an inexpensive material allows the paintbrush accessory to be manufactured and sold as a disposable item. Rather than cleaning and reusing the accessory, a purchaser can choose to purchase a new one.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

While the present invention is discussed with respect to paintbrushes, the accessory is suitable for other uses as well, such as use with other hand tools that might require temporary resting on external supports.

What is claimed is:

1. A paintbrush accessory for attachment to a paintbrush handle, comprising:

a) a paintbrush engaging member having two ends and operable for firmly but removably engaging the handle of a paintbrush;

b) a clip member affixed to the paintbrush engaging member, the clip member operable for removably attaching the paintbrush accessory and an engaged paintbrush to an external support; and c) an elongated spacing member also affixed to the paintbrush engaging member, the spacing member operable to space one end of the paintbrush engaging member away from adjacent external surfaces, the spacing member having a small cross-section adapted to be easily cut, such that the spacing of the paintbrush engaging member away from adjacent surfaces may be modified.

2. The paintbrush accessory of claim 1, integrally formed of a resilient plastic material.

3. The paintbrush accessory of claim 1, wherein the paintbrush engaging member is C-shaped with inner and outer surfaces and a gap opening; the inner surface adapted to be to resiliently conform to the cross-section of a paintbrush handle with which the accessory is to be used; the gap opening adapted to be narrower than the largest cross-sectional dimension of the standard paintbrush handle, such that once installed on a brush handle the paintbrush accessory is securely retained to the paintbrush.

4. The paintbrush accessory of claim 1, wherein the spacing member forms a hook adapted for hanging the paintbrush accessory and an engaged paintbrush on an external support.

5. A paintbrush accessory for temporary attachment to a paintbrush, comprising:

a) means for releasably securing the paintbrush accessory to the handle of a paintbrush;

b) means affixed to the securing means for releasably attaching the paintbrush accessory to an external surface;

c) means affixed to the securing means for spacing a portion of the securing means away from the external surface, the spacing means adapted for easy modification by the user by cutting, such that the spacing of the securing means away from adjacent surfaces may be modified.

6. A paintbrush accessory for temporary attachment to a paintbrush handle, comprising:

a) a paintbrush engaging member having an upper end and a lower end, the paintbrush engaging member being C-shaped with inner and outer surfaces and a gap opening, the inner surface adapted to be to resiliently conform to the cross-section of a paintbrush handle with which the accessory is to be used; the gap opening adapted to be narrower than the largest cross-sectional dimension of the standard paintbrush handle, such that once installed on a brush handle the paintbrush accessory is securely retained to the paintbrush;

b) a clip member affixed to the upper end of the paintbrush engaging member, the clip member operable for removably attaching the paintbrush accessory and paintbrush to an external support;

c) an elongated spacing member affixed to the lower end of the paintbrush engaging member, the spacing member operable to space one end of the paintbrush engaging member away from adjacent external surfaces, the spacing member having a small cross-section adapted to be easily cut, such that the spacing of the paintbrush engaging member away from adjacent surfaces may be modified;

d) the paintbrush accessory being integrally formed of a resilient plastic material.

* * * * *